US006840574B1

(12) United States Patent
Wu

(10) Patent No.: US 6,840,574 B1
(45) Date of Patent: Jan. 11, 2005

(54) FOLDABLE CHAIR ASSEMBLY

(76) Inventor: Chung-Sen Wu, 3F, No. 8, Lane 295, Sec. 1, Fu Sing Na Rd., Taipei (TW)

( * ) Notice: Subject to any disclaimer, the term of this patent is extended or adjusted under 35 U.S.C. 154(b) by 0 days.

(21) Appl. No.: 10/667,053

(22) Filed: Sep. 22, 2003

(51) Int. Cl.[7] ..... A47C 7/62
(52) U.S. Cl. ..... 297/45; 297/188.14
(58) Field of Search ..... 297/45, 44, 42, 297/35, 41, 188.14, 359

(56) References Cited

U.S. PATENT DOCUMENTS 1,955,687 A * 4/1934 Scott ..... 297/320
2,887,150 A * 5/1959 Thomas ..... 297/28
5,611,594 A * 3/1997 Findlay ..... 297/28
6,149,238 A * 11/2000 Tsai ..... 297/411.43
6,502,899 B2 * 1/2003 Tseng ..... 297/28
6,540,290 B2 * 4/2003 Liu ..... 297/45
6,547,321 B2 * 4/2003 Wu ..... 297/16.1
6,547,322 B2 * 4/2003 Marx ..... 297/45
6,634,705 B1 * 10/2003 Zheng ..... 297/41

* cited by examiner

*Primary Examiner*—Milton Nelson, Jr.
(74) *Attorney, Agent, or Firm*—Alan D. Kamrath; Nikolai & Mersereau, P.A.

(57) ABSTRACT

A foldable chair assembly includes a foldable frame, and a positioning unit. The foldable frame includes two auxiliary bars pivotally connected with each other. The positioning unit includes a first control lever having a first end pivotally mounted on one of the two auxiliary bars and a second end formed with a positioning channel, and a second control lever having a first end pivotally mounted on the other auxiliary bar and a second end detachably mounted in the positioning channel of the first control lever. Thus, the foldable frame is folded by pressing the second cover, so that the foldable frame can be folded by his one hand only, thereby facilitating the user folding the foldable frame.

15 Claims, 9 Drawing Sheets

FOLDABLE CHAIR ASSEMBLY

BACKGROUND OF THE INVENTION

1. Field of the Invention

The present invention relates to a foldable chair assembly, and more particularly to a foldable chair assembly, wherein the foldable frame can be folded easily, rapidly and conveniently, thereby facilitating the user folding the foldable chair assembly.

2. Description of the Related Art

A conventional fixed chair forms a rigid and stable support to the user, so that the user can be seated on the chair comfortably. However, the conventional fixed chair has a fixed volume and cannot be folded, thereby causing inconvenience to the user when carrying and storing the chair.

SUMMARY OF THE INVENTION

The primary objective of the present invention is to provide a foldable chair assembly, wherein the foldable frame can be folded easily, rapidly and conveniently, thereby facilitating the user folding the foldable chair assembly.

Another objective of the present invention is to provide a foldable chair assembly, wherein the foldable frame is folded by pressing the second cover, so that the foldable frame can be folded by his one hand only, thereby facilitating the user folding the foldable frame.

A further objective of the present invention is to provide a foldable chair assembly, wherein the inclined angle of the backrest support bars can be adjusted arbitrarily so as to fit the user's requirements.

In accordance with the present invention, there is provided a foldable chair assembly, comprising a foldable frame, and a positioning unit mounted on the foldable frame for folding and extending the foldable frame, wherein:

the foldable frame includes two auxiliary bars pivotally connected with each other;

the positioning unit includes a first control lever, and a second control lever, wherein:

the first control lever has a first end pivotally mounted on one of the two auxiliary bars and a second end formed with a positioning channel; and the second control lever has a first end pivotally mounted on the other one of the two auxiliary bars and a second end pivotally connected with the second end of the first control lever, the second end of the second control lever is detachably mounted in the positioning channel of the first control lever.

Further benefits and advantages of the present invention will become apparent after a careful reading of the detailed description with appropriate reference to the accompanying drawings.

DETAILED DESCRIPTION OF THE INVENTION

Figure 1:
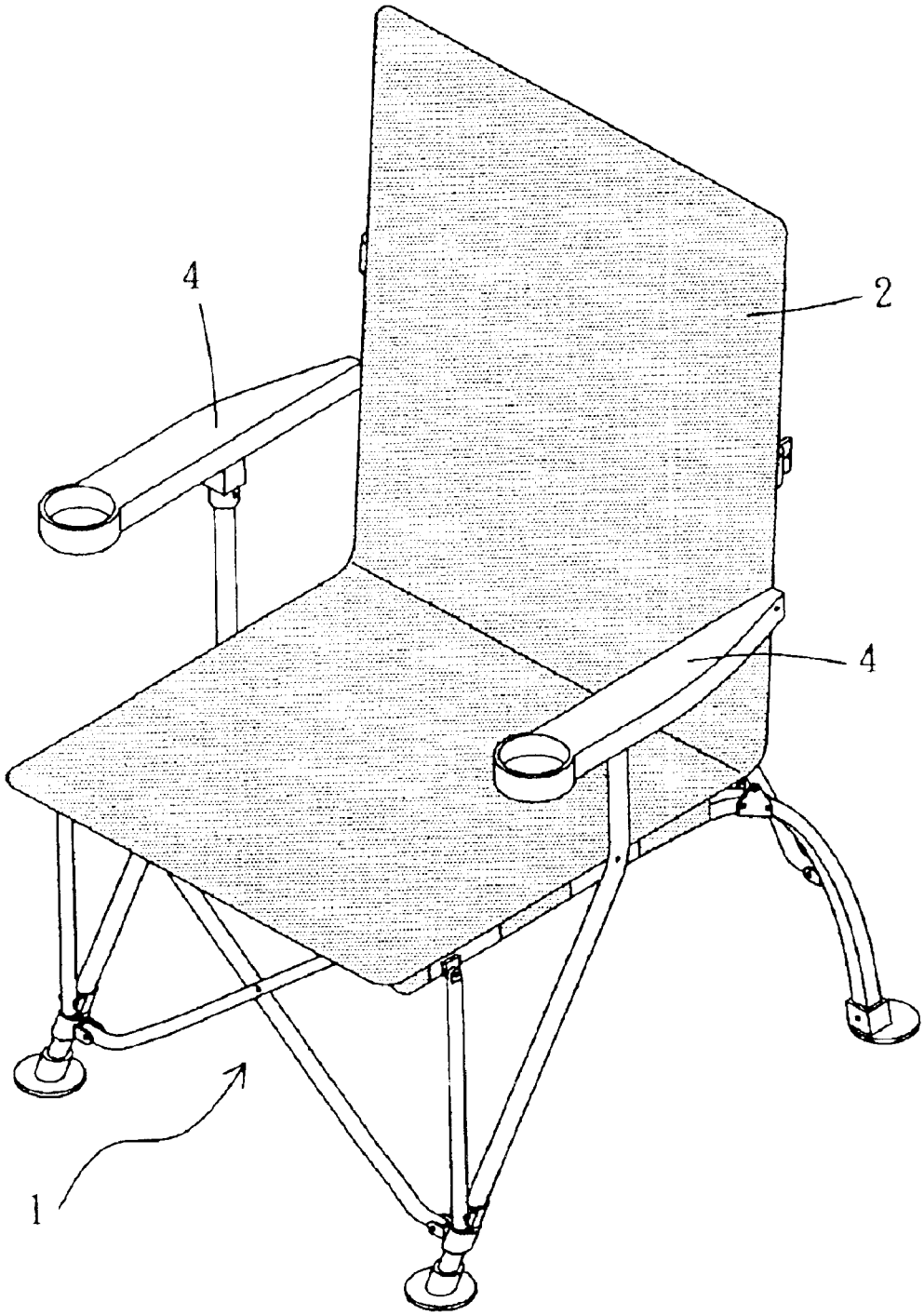
FIG. 1 is a perspective view of a foldable chair assembly in accordance with the preferred embodiment of the present invention.

Referring to the drawings and initially to FIGS. 1–6, a foldable chair assembly in accordance with the preferred embodiment of the present invention comprises a foldable frame 1, a seat cushion 2 mounted on the foldable frame 1, a positioning unit 3 mounted on the foldable frame 1 for folding and extending the foldable frame 1, and two armrests 4 each mounted on the foldable frame 1.

The foldable frame 1 includes two seat support bars 14, two backrest support bars 12, two auxiliary bars 121, and two armrest support bars 11. Each of the two backrest support bars 12 is pivotally mounted on a respective one of the two seat support bars 14. The two auxiliary bars 121 are pivotally connected with each other and are pivotally mounted between the two backrest support bars 12 and the two seat support bars 14. Each of the two auxiliary bars 121 has a first end pivotally mounted on a respective one of the two backrest support bars 12 and a second end pivotally mounted on a respective one of the two seat support bars 14. Each of the two armrest support bars 11 is pivotally mounted on a respective one of the two seat support bars 14.

The positioning unit 3 includes a first control lever 32, a second control lever 33, a first cover 31, and a second cover 35.

The first control lever 32 has a first end pivotally mounted on one of the two auxiliary bars 121 and a second end formed with a positioning channel 321. The second end of the first control lever 32 is formed with a pivot hole 322.

The second control lever 33 has a first end pivotally mounted on the other one of the two auxiliary bars 121 and a second end pivotally connected with the second end of the first control lever 32. The second end of the second control lever 33 is detachably mounted in the positioning channel 321 of the first control lever 32. The second end of the second control lever 33 is formed with a pivot hole 331.

The first cover 31 is secured on the second end of the first control lever 32 and has a periphery formed with an annular flange 313. The flange 313 of the first cover 31 has a first side formed with an elongated slot 315 for passage of the first control lever 32 and a second side formed with a receiving opening 314 for receiving the second end of the first control lever 32. Preferably, the elongated slot 315 of the first cover 31 is located radially opposite to the receiving opening 314. The first cover 31 has a center formed with a protruding column 312 extended through the pivot hole 322 of the first control lever 32 and the pivot hole 331 of the second control lever 33. The column 312 of the first cover 31 is formed with a through hole 311.

The second cover 35 is secured on the first cover 31 and has a periphery formed with an annular flange 352 rested on the flange 313 of the first cover 31. The flange 352 of the second cover 35 has a side formed with a guide channel 353, and the second end of the second control lever 33 is movably mounted in the guide channel 353 of the second cover 35. The second cover 35 has a center formed with a through hole 351.

The foldable frame 1 further includes a spring 34 mounted on the column 312 of the first cover 31 and urged on the second end of the second control lever 33 for pushing the second control lever 33 toward the first control lever 32. The spring 34 has a first end urged on the second end of the second control lever 33 and a second end urged on a wall of the second cover 35.

The foldable frame 1 further includes a pivot shaft 36 extended through the through hole 351 of the second cover 35 and the through hole 311 of the column 312 of the first cover 31, and a washer 37 secured on an end of the pivot shaft 36 and rested on a wall of the first cover 31.

Figure 2:
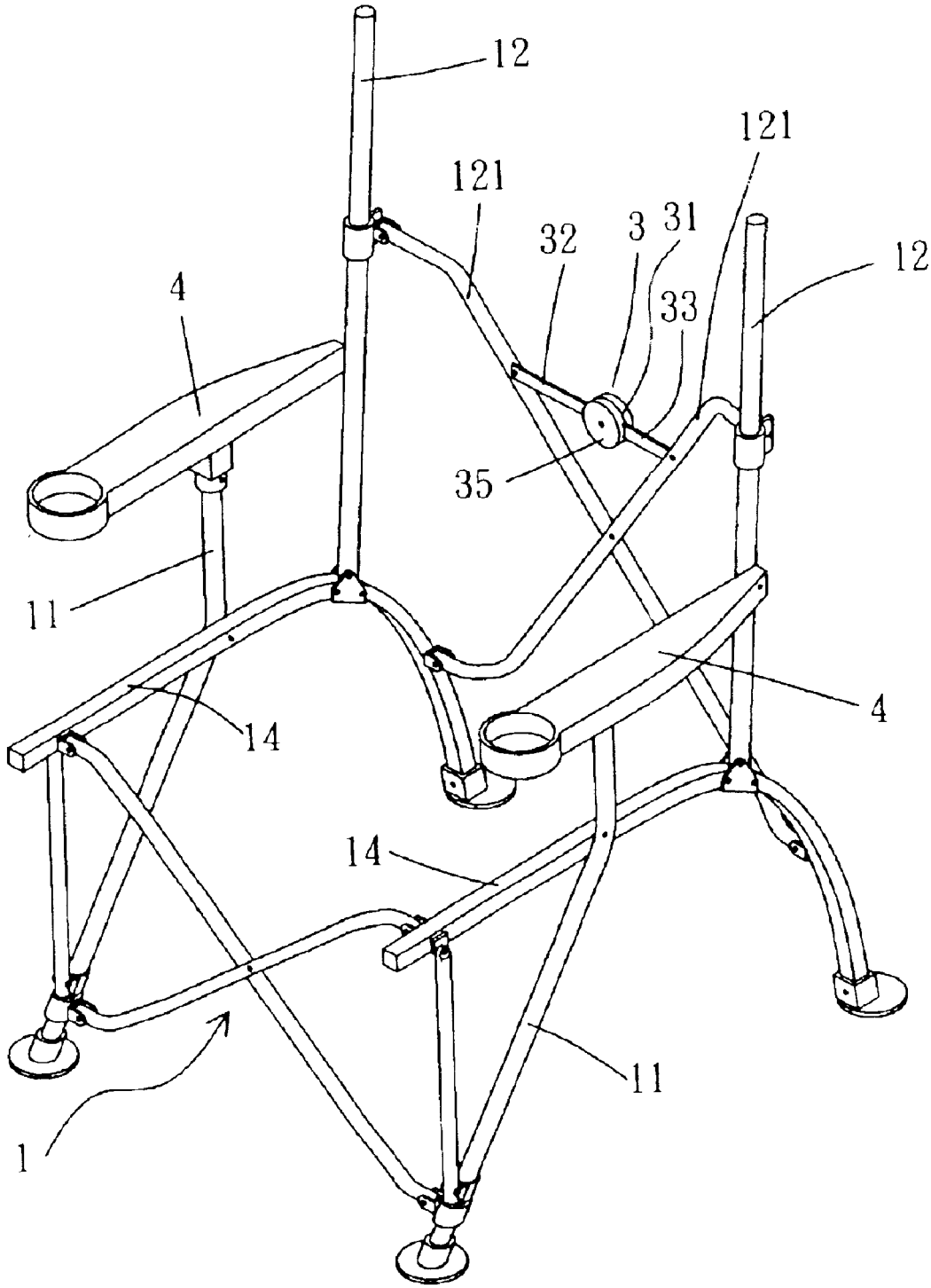
FIG. 2 is a partially perspective view of the foldable chair assembly in accordance with the preferred embodiment of the present invention.
Figure 3:
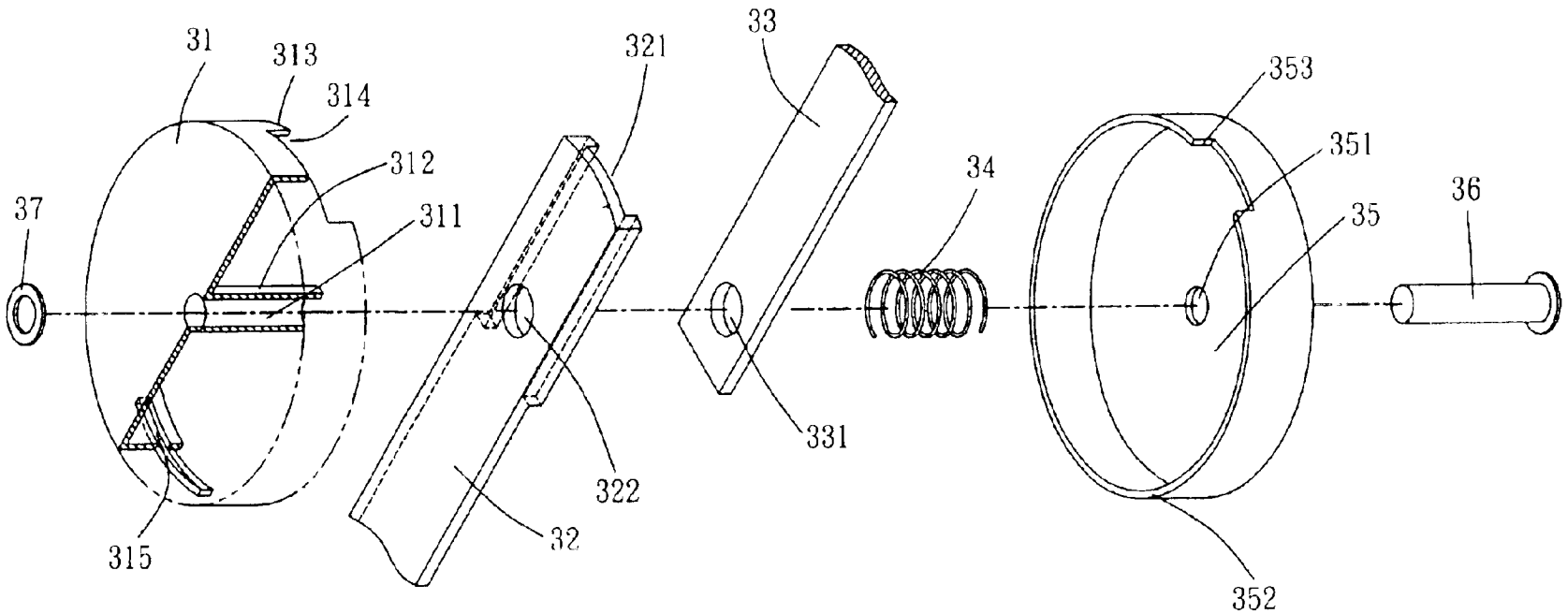
FIG. 3 is a partially cut-away exploded perspective view of a positioning unit of the foldable chair assembly in accordance with the preferred embodiment of the present invention.
Figure 4:
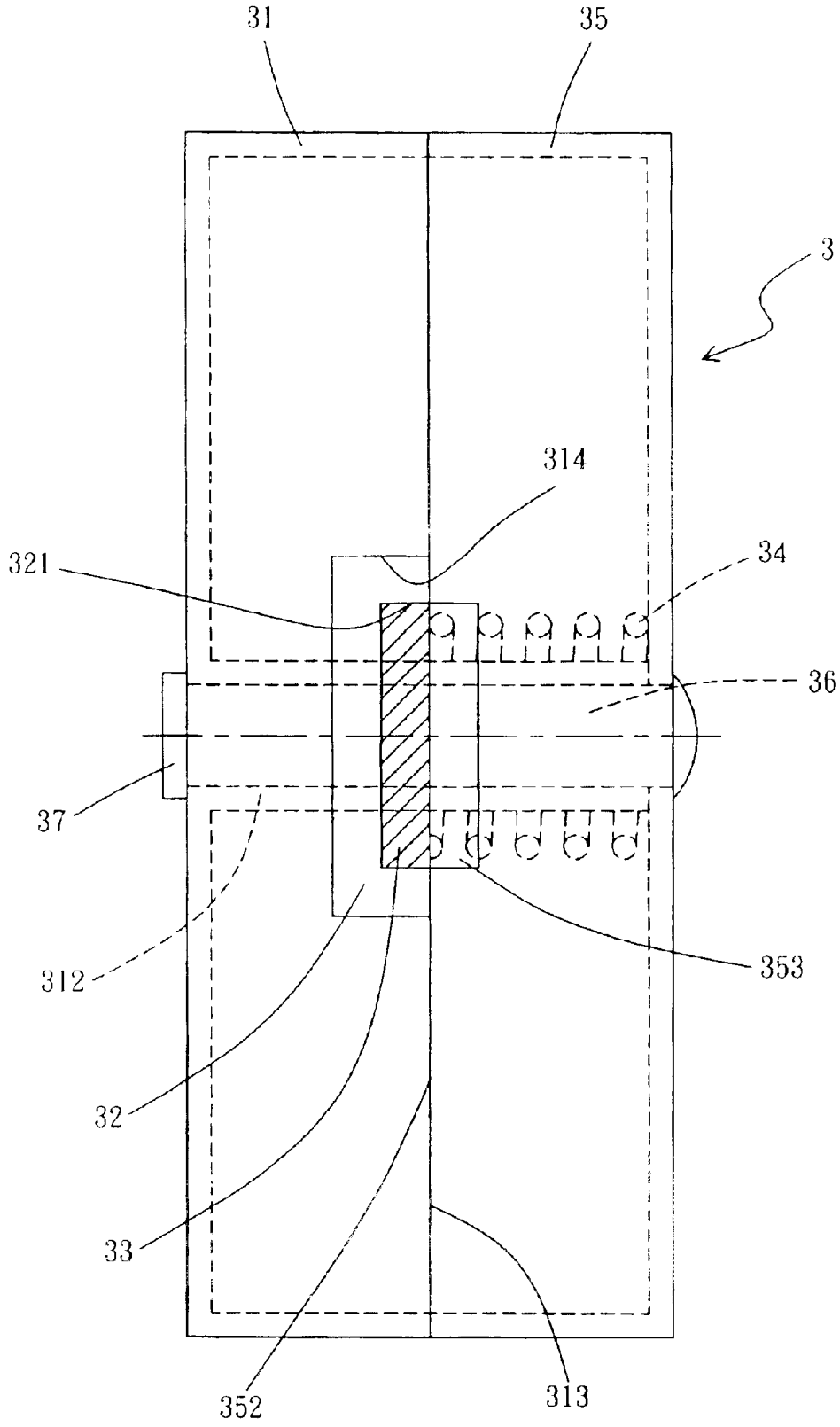
FIG. 4 is a partially plan cross-sectional assembly view of the positioning unit of the foldable chair assembly as shown in FIG. 3.
Figure 6:
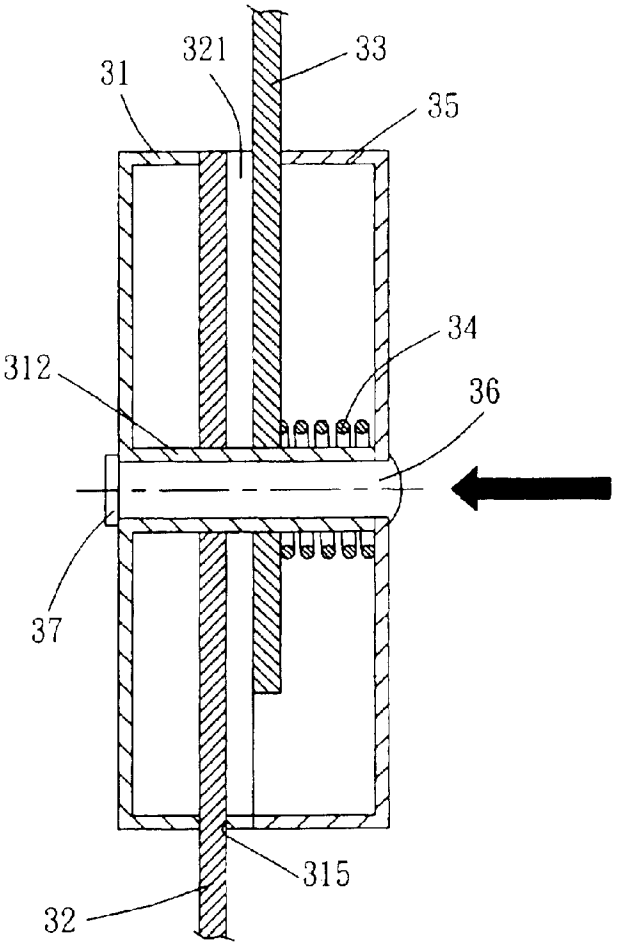
FIG. 6 is a schematic operational view of the positioning unit of the foldable chair assembly as shown in FIG. 5.
Figure 5:
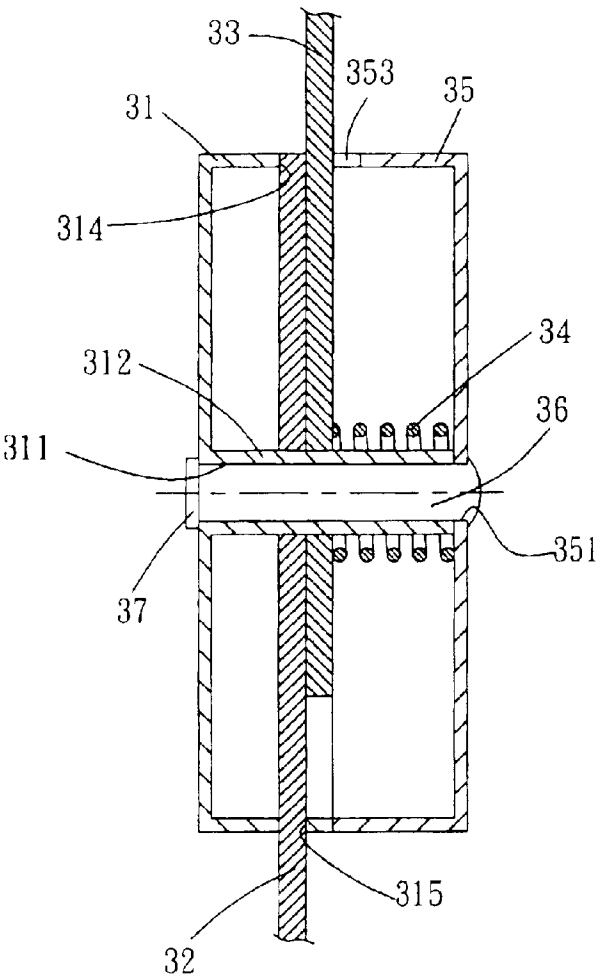
FIG. 5 is a plan cross-sectional assembly view of the positioning unit of the foldable chair assembly as shown in FIG. 3.
Figure 7:
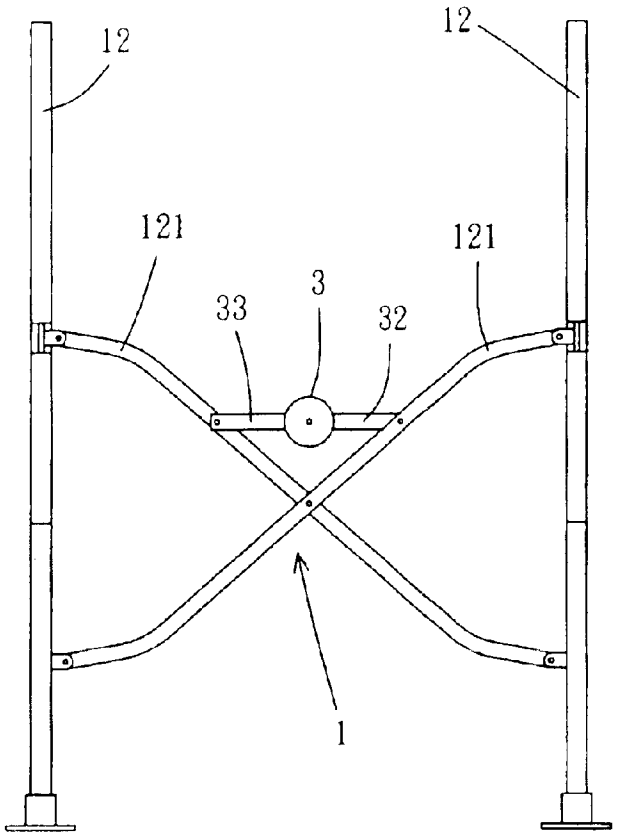
FIG. 7 is a plan view of the foldable chair assembly as shown in FIG. 2.

In operation, referring to FIGS. 5–9 with reference to FIGS. 1–4, the second end of the second control lever 33 is initially retained in the positioning channel 321 of the first control lever 32 by the elastic force applied by the spring 34 as shown in FIG. 5, so that the second control lever 33 is fixed on the first control lever 32, and the foldable frame 1 is disposed at a fixed state as shown in FIGS. 2 and 7.

Figure 9:
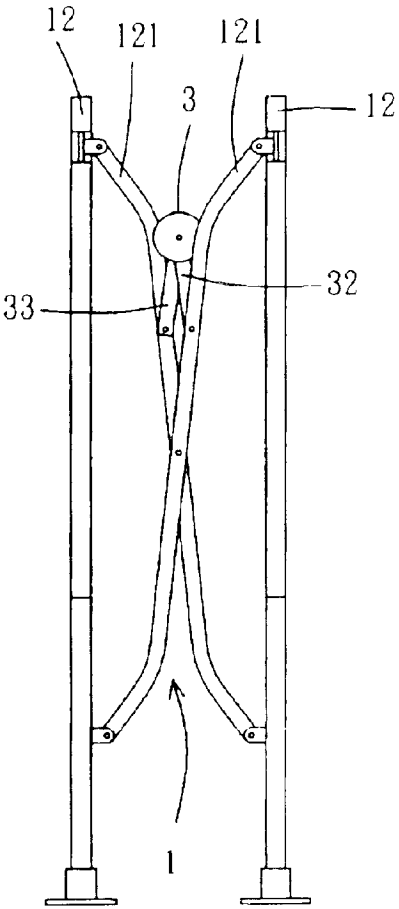
FIG. 9 is a schematic operational view of the foldable chair assembly as shown in FIG. 8.
Figure 8:
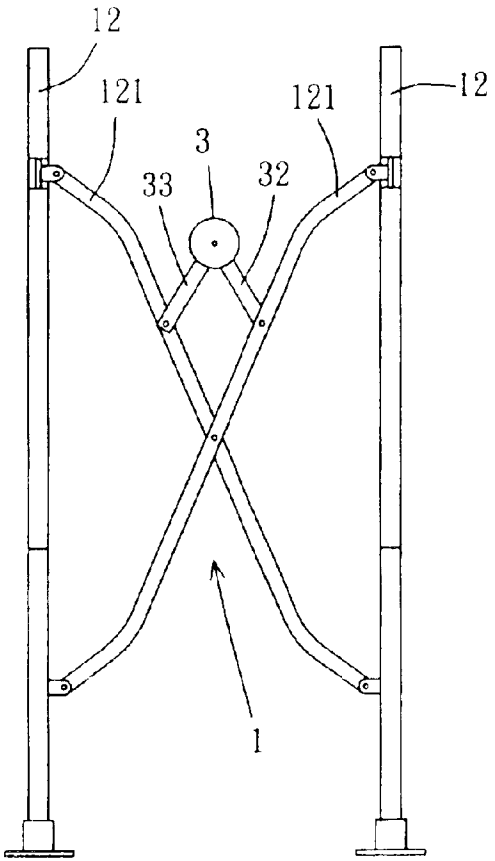
FIG. 8 is a schematic operational view of the foldable chair assembly as shown in FIG. 7.

When the user wishes to fold the foldable frame 1, the second cover 35 is pressed toward the first cover 31 to move the first cover 31 which drives the second end of the first control lever 32 to move outward relative to the second end of the second control lever 33, so that the second end of the second control lever 33 is detached from the positioning channel 321 of the first control lever 32 and received in the guide channel 353 of the second cover 35 as shown in FIG. 6. Thus, the second control lever 33 is pivoted relative to the first control lever 32 to pivot and fold the two auxiliary bars 121 and the two backrest support bars 12, thereby folding the foldable frame 1 as shown in FIGS. 8 and 9.

Figure 10:
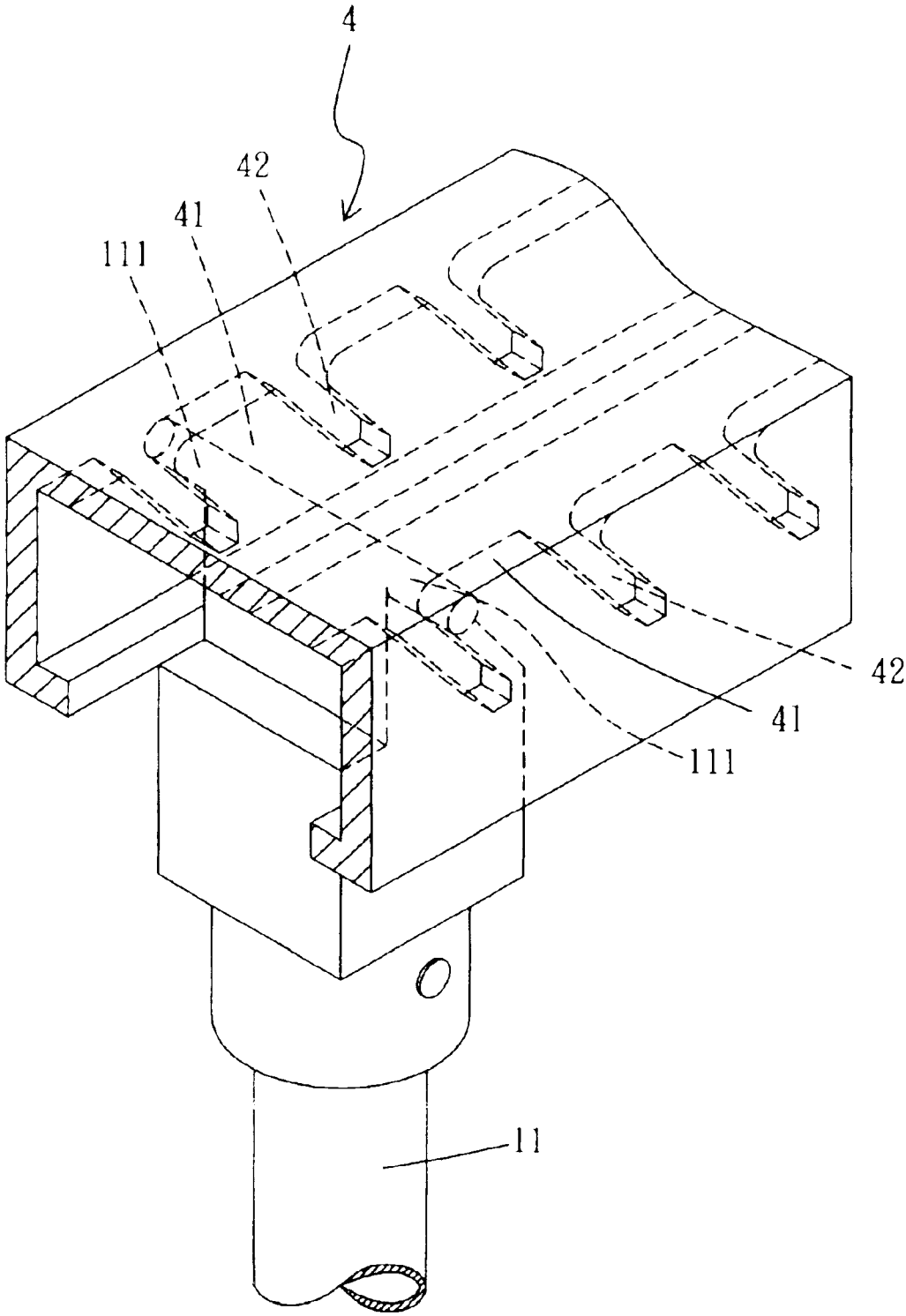
FIG. 10 is a partially cut-away cross-sectional view of the foldable chair assembly as shown in FIG. 1.
Figure 11:
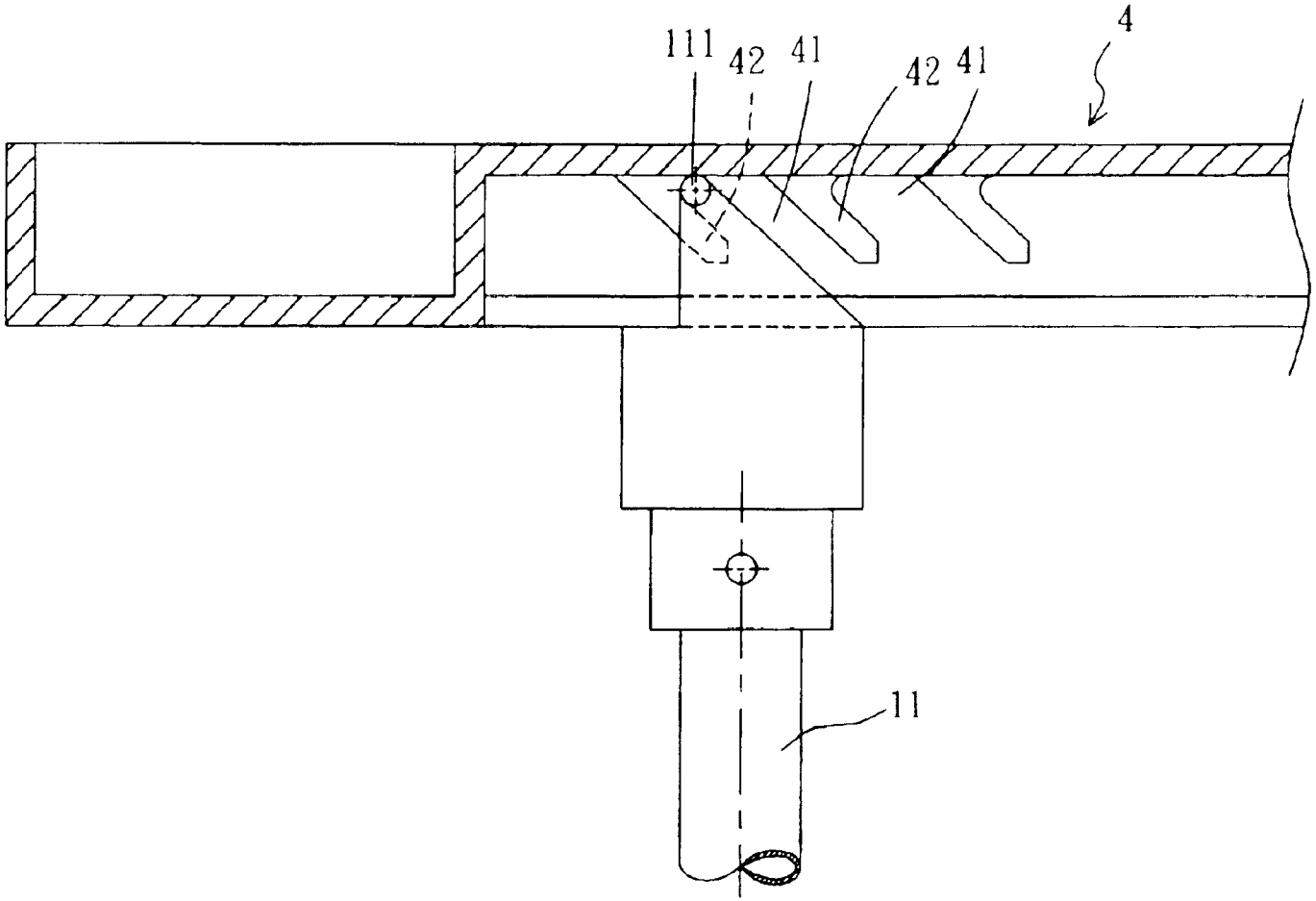
FIG. 11 is a side plan cross-sectional view of the foldable chair assembly as shown in FIG. 10.
Figure 12:
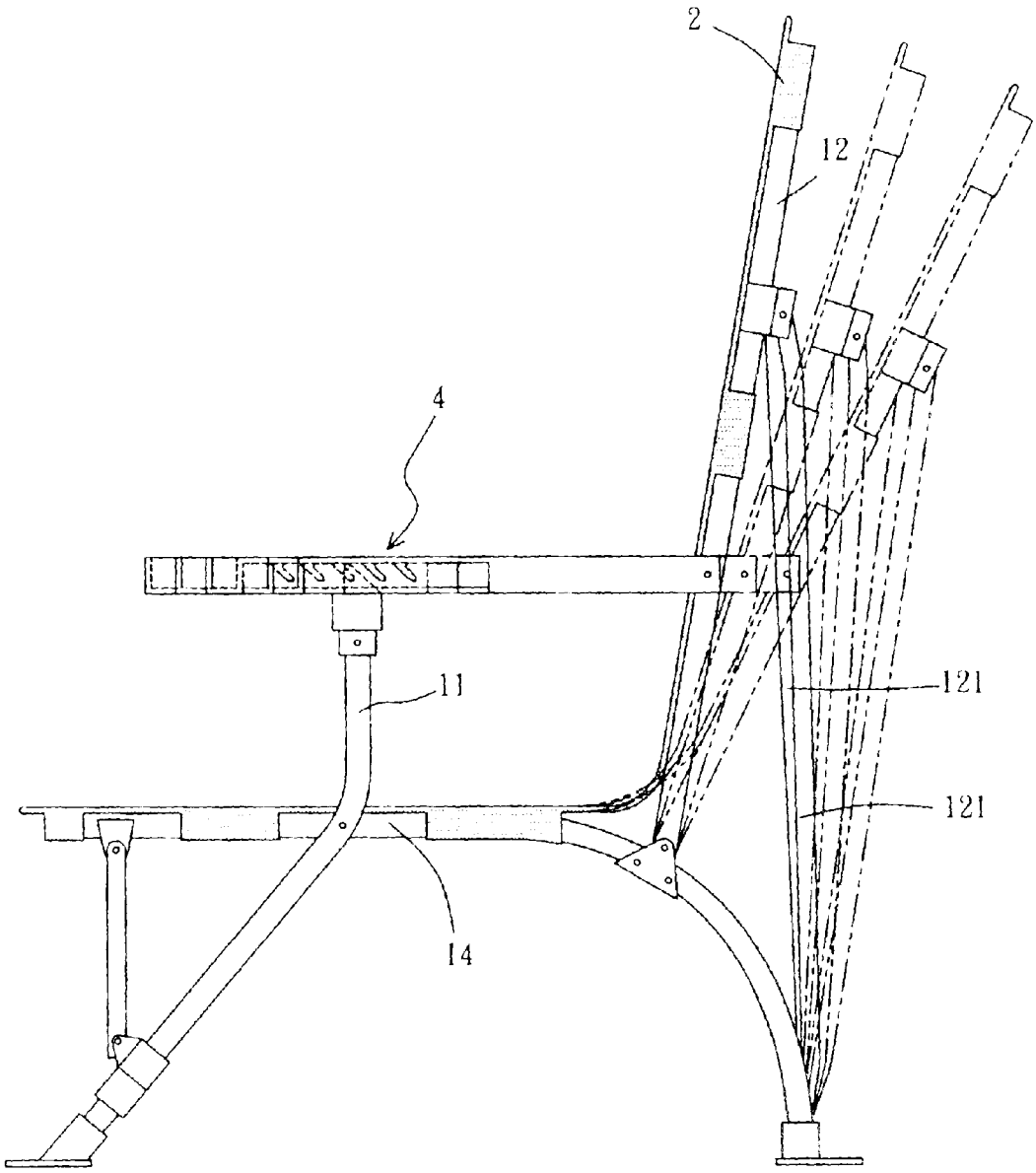
FIG. 12 is a schematic side plan operational view of the foldable chair assembly as shown in FIG. 2.

Referring to FIGS. 10–12 with reference to FIGS. 1 and 2, each of the two armrests 4 has a first end pivotally mounted on a respective one of the two backrest support bars 12 and a second end adjustably mounted on a respective one of the two armrest support bars 11. Each of the two armrests 4 has a substantially inverted U-shaped cross-section, and has two sides each formed with a plurality of receiving chambers 41 and a plurality of locking portions 42 located between the receiving chambers 41. Preferably, each of the locking portions 42 is arranged at an oblique state. Each of the two armrest support bars 11 has an upper end formed with a transverse rod 111 adjustably mounted in one of the receiving chambers 41 of the respective armrest 4 and locked by the respective the locking portion 42, so that each of the two armrests 4 is adjustably moved on the respective armrest support bar 11 so as to pivot the respective backrest support bar 12 relative to the respective seat support bar 14, thereby adjusting the inclined angle of the two backrest support bars 12 as shown in FIG. 12.

Accordingly, the foldable frame 1 can be folded easily, rapidly and conveniently, thereby facilitating the user folding the foldable frame 1. In addition, the foldable frame 1 is folded by pressing the second cover 35, so that the foldable frame 1 can be folded by his one hand only, thereby facilitating the user folding the foldable frame 1. Further, the inclined angle of the backrest support bars 12 can be adjusted arbitrarily so as to fit the user's requirements.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A foldable chair assembly, comprising a foldable frame, and a positioning unit mounted on the foldable frame for folding and extending the foldable frame, wherein:

the foldable frame includes two auxiliary bars pivotally connected with each other;

the positioning unit includes a first control lever, and a second control lever, wherein:

the first control lever has a first end pivotally mounted on one of the two auxiliary bars and a second end formed with a positioning channel; and the second control lever has a first end pivotally mounted on the other one of the two auxiliary bars and a second end pivotally connected with the second end of the first control lever, the second end of the second control lever is detachably mounted in the positioning channel of the first control lever.

2. The foldable chair assembly in accordance with claim 1, wherein the positioning unit further includes a first cover secured on the second end of the first control lever and having a periphery formed with an annular flange, and a second cover secured on the first cover and having a periphery formed with an annular flange rested on the flange of the first cover.

3. The foldable chair assembly in accordance with claim 2, wherein the second end of the first control lever is formed with a pivot hole, the second end of the second control lever is formed with a pivot hole, and the first cover has a center formed with a protruding column extended through the pivot hole of the first control lever and the pivot hole of the second control lever.

4. The foldable chair assembly in accordance with claim 3, wherein the column of the first cover is formed with a through hole, the second cover has a center formed with a through hole, and the foldable frame further includes a pivot shaft extended through the through hole of the second cover and the through hole of the column of the first cover, and a washer secured on an end of the pivot shaft and rested on a wall of the first cover.

5. The foldable chair assembly in accordance with claim 3, wherein the foldable frame further includes a spring mounted on the column of the first cover and urged on the second end of the second control lever for pushing the second control lever toward the first control lever.

6. The foldable chair assembly in accordance with claim 5, wherein the spring has a first end urged on the second end of the second control lever and a second end urged on a wall of the second cover.

7. The foldable chair assembly in accordance with claim 6, wherein the flange of the first cover has a first side formed with an elongated slot for passage of the first control lever and a second side formed with a receiving opening for receiving the second end of the first control lever.

8. The foldable chair assembly in accordance with claim 7, wherein the elongated slot of the first cover is located radially opposite to the receiving opening.

9. The foldable chair assembly in accordance with claim 2, wherein the flange of the second cover has a side formed with a guide channel, and the second end of the second control lever is movably mounted in the guide channel of the second cover.

10. The foldable chair assembly in accordance with claim 1, wherein the foldable frame further includes two seat support bars, two backrest support bars each pivotally mounted on a respective one of the two seat support bars, and two armrest support bars each pivotally mounted on a respective one of the two seat support bars, and the two auxiliary bars are pivotally mounted between the two backrest support bars and the two seat support bars.

11. The foldable chair assembly in accordance with claim 10, wherein each of the two auxiliary bars has a first end pivotally mounted on a respective one of the two backrest support bars and a second end pivotally mounted on a respective one of the two seat support bars.

12. The foldable chair assembly in accordance with claim 10, further comprising two armrests each mounted on the foldable frame, and each having a first end pivotally mounted on a respective one of the two backrest support bars and a second end adjustably mounted on a respective one of the two armrest support bars.

13. The foldable chair assembly in accordance with claim 12, wherein each of the two armrests has a substantially inverted U-shaped cross-section.

14. The foldable chair assembly in accordance with claim 12, wherein each of the two armrests has two sides each formed with a plurality of receiving chambers and a plurality of locking portions located between the receiving chambers, and each of the two armrest support bars has an upper end formed with a transverse rod adjustably mounted in one of the receiving chambers of the respective armrest and locked by the respective locking portion, so that each of the two armrests is adjustably moved on the respective armrest support bar so as to pivot the respective backrest support bar relative to the respective seat support bar.

15. The foldable chair assembly in accordance with claim 14, wherein each of the locking portions is arranged at an oblique state.

* * * * *